US006758613B2

(12) United States Patent
White et al.

(10) Patent No.: US 6,758,613 B2
(45) Date of Patent: Jul. 6, 2004

(54) METHOD AND SYSTEM FOR ENVIRONMENTAL CONTROL DURING FILM PROCESSING

(75) Inventors: Mark White, Austin, TX (US); Angela Cheng, Austin, TX (US); Paul N. Winberg, Austin, TX (US); Michael Rohrer, Cedar Park, TX (US)

(73) Assignee: Eastman Kodak Company, Rochester, NY (US)

( * ) Notice: Subject to any disclaimer, the term of this patent is extended or adjusted under 35 U.S.C. 154(b) by 92 days.

(21) Appl. No.: 10/036,739

(22) Filed: Dec. 31, 2001

(65) Prior Publication Data

US 2002/0115027 A1 Aug. 22, 2002

Related U.S. Application Data

(60) Provisional application No. 60/259,006, filed on Dec. 29, 2000.

(51) Int. Cl.[7] ..... G03D 5/00; G03D 13/00

(52) U.S. Cl. ..... 396/571; 396/578; 396/604; 396/624; 355/27

(58) Field of Search ..... 396/571, 578, 396/604, 612, 624, 627; 355/27–29; 134/64 P, 64 R; 219/216

(56) References Cited

U.S. PATENT DOCUMENTS 6,099,174 A * 8/2000 Feumi Jantou et al. ..... 396/571
6,213,657 B1 * 4/2001 Kobayashi ..... 396/604
6,241,401 B1 * 6/2001 Sanada et al. ..... 396/604
6,328,488 B1 * 12/2001 Kobayashi ..... 396/604
6,412,990 B1 * 7/2002 Stoffel et al. ..... 396/599

* cited by examiner

*Primary Examiner*—D. Rutledge
(74) *Attorney, Agent, or Firm*—Simon, Galasso and Frantz PLC

(57) ABSTRACT

A method and system for environmental control in film processing is disclosed. In general, photographic film is coated with a processing solution, such as a developer solution, and is then developed within a controlled air environment. In the preferred embodiments, the temperature and humidity within the air environment is strictly controlled, which allows the development process to be more accurately and consistently controlled. This also allows fewer processing chemicals to be used and reduces harmful effluents caused by photographic film processing.

56 Claims, 7 Drawing Sheets

METHOD AND SYSTEM FOR ENVIRONMENTAL CONTROL DURING FILM PROCESSING

CROSS REFERENCE TO RELATED APPLICATIONS

This application claims priority under 35 U.S.C. 119(e) to U.S. Provisional Patent Application No. 60/259,006, entitled *Method and System for a Microenvironment in Digital Film Processing*, having a priority filing date of Dec. 29, 2000, and Attorney Docket Number ASF00119.

This application is related to the on copending U.S. Patent Applications: patent application Ser. No. 09/751,378, now U.S. Pat. No. 6,461,061, entitled *Improved System and Method for Digital Film Development Using Visible Light*, having a priority filing date of Dec. 30, 1999 and Attorney Docket Number ASF99324; patent application Ser. No. 09/752,013, entitled *System and Method for Digital Film Development Using Visible Light*, having a priority filing date of Dec. 30, 1999 and Attorney Docket Number ASF99286; U.S. patent application Ser. No. 09/774,544, now U.S. Pat. No. 6,619,863, entitled *Method and System for Capturing Film Images*, having a priority filing date of Feb. 03, 2000 and Attorney Docket Number ASF00005.

TECHNICAL FIELD OF THE INVENTION

This invention generally relates to photographic film processing and more specifically to a method and system for environmental control during film processing.

BACKGROUND OF THE INVENTION

Images are used to communicate information and ideas. Images, including print pictures, film negative, documents and the like are often digitized to produce a digital image that can then be instantly communicated, viewed, enhanced, modified, printed or stored. The increasing use and flexibility of digital images, as well as the ability to instantly communicate digital images, has led to a rising demand for improved systems and methods for film processing and the digitization of film based images into digital images. Film based images are traditionally digitized by electronically scanning a film negative or film positive that has been conventionally developed using a wet chemical developing process.

Conventional wet chemical developing processes generally utilize a series of tanks containing various processing solutions. The undeveloped film is fully immersed into each in a series of tanks containing various processing solutions. At a minimum, a conventional wet chemical developing process includes individual tanks for developing, fixing, bleaching and drying, as well as various rinsing operations. The concentration and temperature of the processing solution within each tank is precisely controlled. Because the chemical reaction occurs while the film is immersed in the processing solution, the film processing parameters are easily controlled. Conventional wet chemical developing removes the elemental silver and silver halide from the film to produce a film negative having a dye image. The film negative can be scanned or used to produce traditional photographic prints.

A relatively new process under development is digital film processing (DFP). DFP systems scan film during the film development process. Generally, DFP systems scan the film without chemically removing the elemental silver or the silver halide from the film.

As a result, fewer hazardous effluents are produced by the development process. Conventional DFP systems generally utilize an applicator to apply a layer of processing solution to the photographic film. The film is then looped to allow the processing solution time to react with the film.

SUMMARY OF THE INVENTION

A method and system for environment control during film processing is provided. In one implementation of the present invention, a development tunnel is provided. In one embodiment, the development tunnel comprises a housing that forms a development chamber. Photographic film coated with a developer solution is transported through development chamber. The development chamber operates to maintain a relatively constant temperature and humidity of the coated film during development of the film.

In another implementation of the present invention, a photographic film processing system is provided. In one embodiment, the photographic film processing system comprises an applicator station, development station, and a transport system. The applicator station operates to coat a developer solution onto a photographic film. The development station operates to heat coated photographic film in an air environment. The transport system operates to transport the film through the applicator station and development station.

In yet another implementation of the present invention, a method of processing photographic film is provided. In one embodiment, the method comprises coating a development solution onto the photographic film and then transporting the coated photographic film through a development station that operates to develop the coated photographic film in a controlled air environment.

The invention has several important technical advantages. Various embodiments of the present invention may have none, some, or all of these advantages. An advantage of at least one embodiment is that the film is developed in a controlled air environment that reduces processing variations in the developing film. As a result, improved images are produced from the development process.

Another advantage of at least one embodiment is that environmentally hazardous effluents are not created by the removal of elemental silver and/or silver halide from the film. In particular, no water plumbing is required to process the film in accordance with at least one embodiment of the invention. As a result, this embodiment is less expensive than conventional wet chemical processing systems and can be located at any location. In contrast, conventional wet chemical processing of film requires water plumbing and removes the elemental silver and silver halide from the film, which produces environmentally hazardous effluents that are controlled by many government regulatory agencies.

Another advantage of at least one embodiment of the invention is that the invention can be embodied in simple user operated film processing system, such as a self-service kiosk. In this embodiment, skilled technicians are not required; thereby reducing the cost associated developing and processing film. In addition, at least one embodiment of the invention allows the film to be developed and processed faster than conventional wet chemical processing of the film.

Other technical advantages will be readily apparent to one skilled in the art from the following figures, descriptions, and claims.

BRIEF DESCRIPTION OF THE DRAWINGS

For a more complete understanding of the invention and the advantages thereof, reference is now made to the following description taken in conjunction with the accompanying drawings, wherein like reference numerals represent like parts, in which:

FIGS. 2B-1 through 2B-4 are schematic diagrams illustrating various embodiments of a halt station shown in FIG. 2B;

FIG. 3 is a schematic diagram illustrating a scanning system shown in FIG. 1;

DETAILED DESCRIPTION OF THE INVENTION

FIGS. 1 through 5B illustrate various embodiments of a method and system for environmental control during film processing. The method and system for environmental control is illustrated in terms of a digital film processing system. It should be understood that the present invention may be used in any type of film processing system without departing from the spirit and scope of this invention. For example, the present invention may be used in a traditional wet chemistry process in which each individual processing solution is applied as a coating to the film and reacts within an environmental tunnel instead of being immersed within the processing solution.

Figure 1:
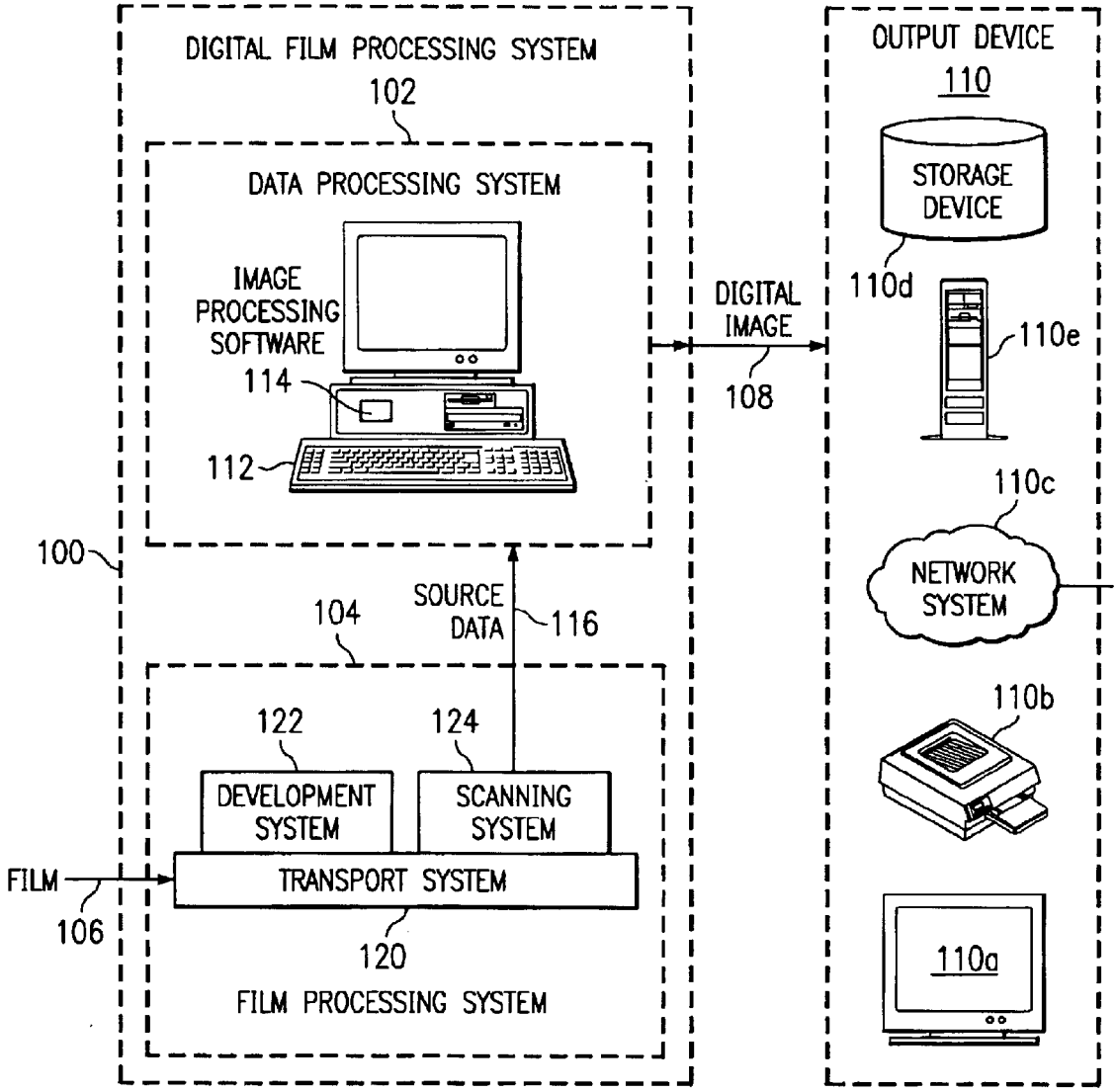
FIG. 1 is a schematic diagram of an improved digital film processing system in accordance with the invention.

FIG. 1 is a diagram of an improved film processing system 100 in accordance with one embodiment of the invention. In this embodiment, the improved film processing system 100 comprises a data processing system 102 and a film processing system 104 that operates to develop and digitize a film 106 to produce a digital image 108 that can be output to an output device 110. Film 106, as used herein, includes color, black and white, x-ray, infrared or any other type of film, and is not meant to refer to any specific type of film or a specific manufacturer.

Data processing system 102 comprises any type of computer or processor operable to process data. For example, data processing system 102 may comprise a personal computer manufactured by Apple Computing, Inc. of Cupertino, Calif. or International Business Machines of New York. Data processing system 102 may also comprise any number of computers or individual processors, such as application specific integrated circuits (ASICs). Data processing system 102 may include an input device 112 operable to allow a user to input information into the improved film processing system 100. Although input device 112 is illustrated as a keyboard, input device 112 may comprise any input device, such as a keypad, mouse, point-of-sale device, voice recognition system, memory reading device such as a flash card reader, or any other suitable data input device.

Data processing system 102 includes image processing software 114 resident on the data processing system 102. Film processing system 102 receives sensor data 116 from film processing system 104. As described in greater detail below, sensor data 116 is representative of the colors in the film 106 at each discrete location, or pixel, of the film 106. The sensor data 116 is processed by image processing software 114 to produce the digital image 108.

In the preferred embodiment, each individual pixel color record is compensated to remove the effect of elemental silver or silver halide within the film 106. In this embodiment, digitally compensating for the silver in the film 106 instead of chemically removing the elemental silver and/or silver halide from film 106 substantially reduces or eliminates the production of hazardous chemical effluents that are generally produced during conventional film processing methods. Although the image processing software 114 is described in terms of actual software, the image processing software 114 may be embodied as hardware, such as an ASIC. The color records for each pixel form the digital image 108, which is then communicated to one or more output devices 110.

Output device 110 may comprise any type or combination of suitable devices for displaying, storing, printing, transmitting or otherwise outputting the digital image 108. For example, as illustrated, output device 110 may comprise a monitor 110*a*, a printer 110*b*, a network system 110*c*, a mass storage device 110*d*, a computer system 110*e*, or any other suitable output device. Network system 118*c* may be any network system, such as the Internet, a local area network, and the like. Mass storage device 110*d* may be a magnetic or optical storage device, such as a floppy drive, hard drive, removable hard drive, optical drive, CD-ROM drive, and the like. Computer system 110*e* may be used to further process or enhance the digital image 108.

As described in greater detail below, film processing system 104 operates to develop and electronically scan the developed film 106 to produce the sensor data 116. As illustrated, the film processing system 104 comprises a transport system 120, a development system 122, and a scanning system 124. Transport system 120 operates to dispense and move the film 106 through the improved film processing system 100. In a preferred embodiment, the transport system 120 comprises a leader transport system in which a leader is spliced to the film 106 and a series of rollers pulls the film 106 through the film processing system 104, with care taken that the image surface of the film 106 is not contacted. Similar transport systems 120 are found in film products manufactured by, for example, Noritsu Koki Co. of Wakayama, Japan, and are available to those skilled in the art.

Figure 2A:
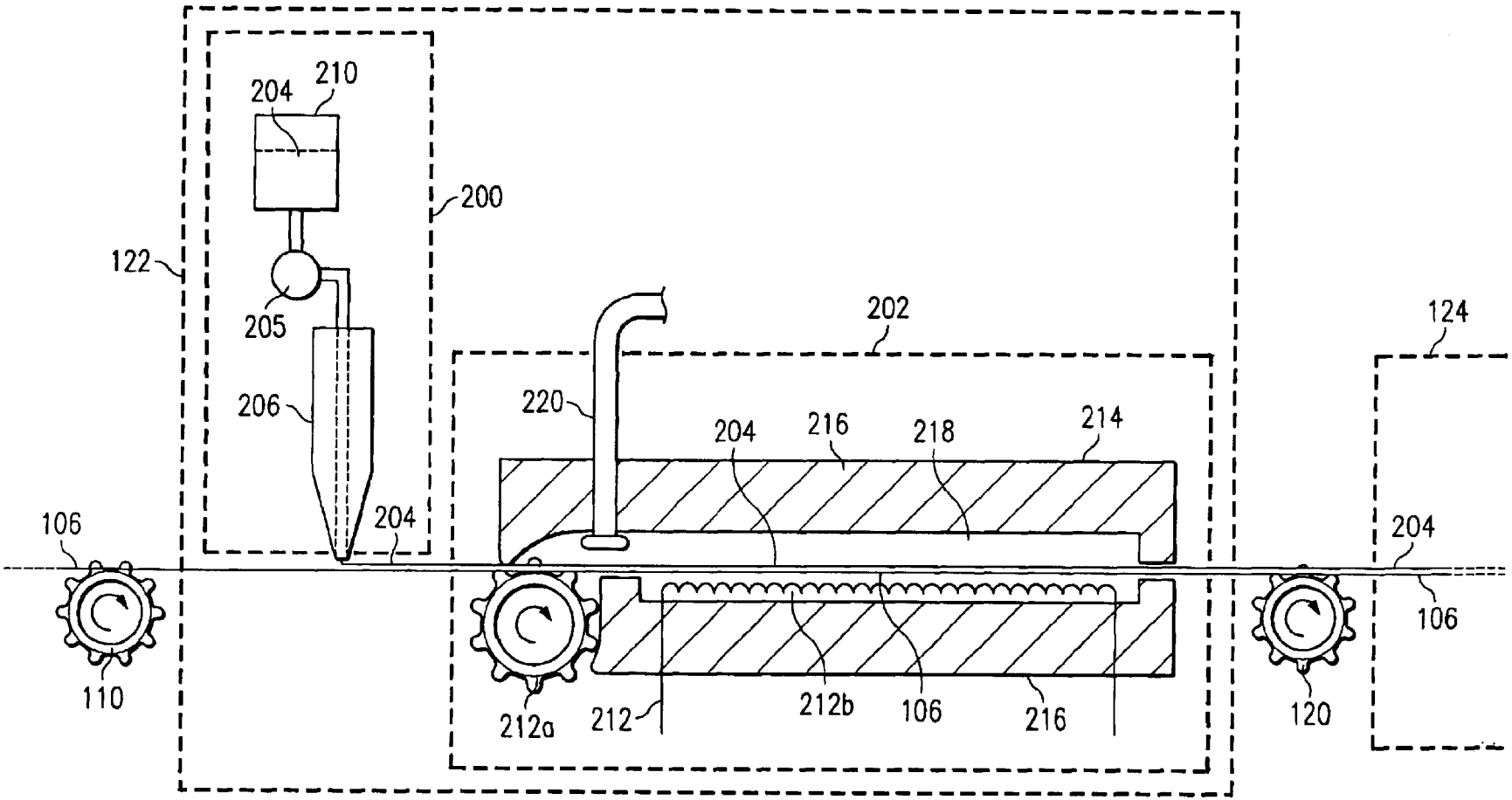
FIG. 2A is a schematic diagram illustrating one embodiment of a development system shown in FIG. 1.
Figure 2B:
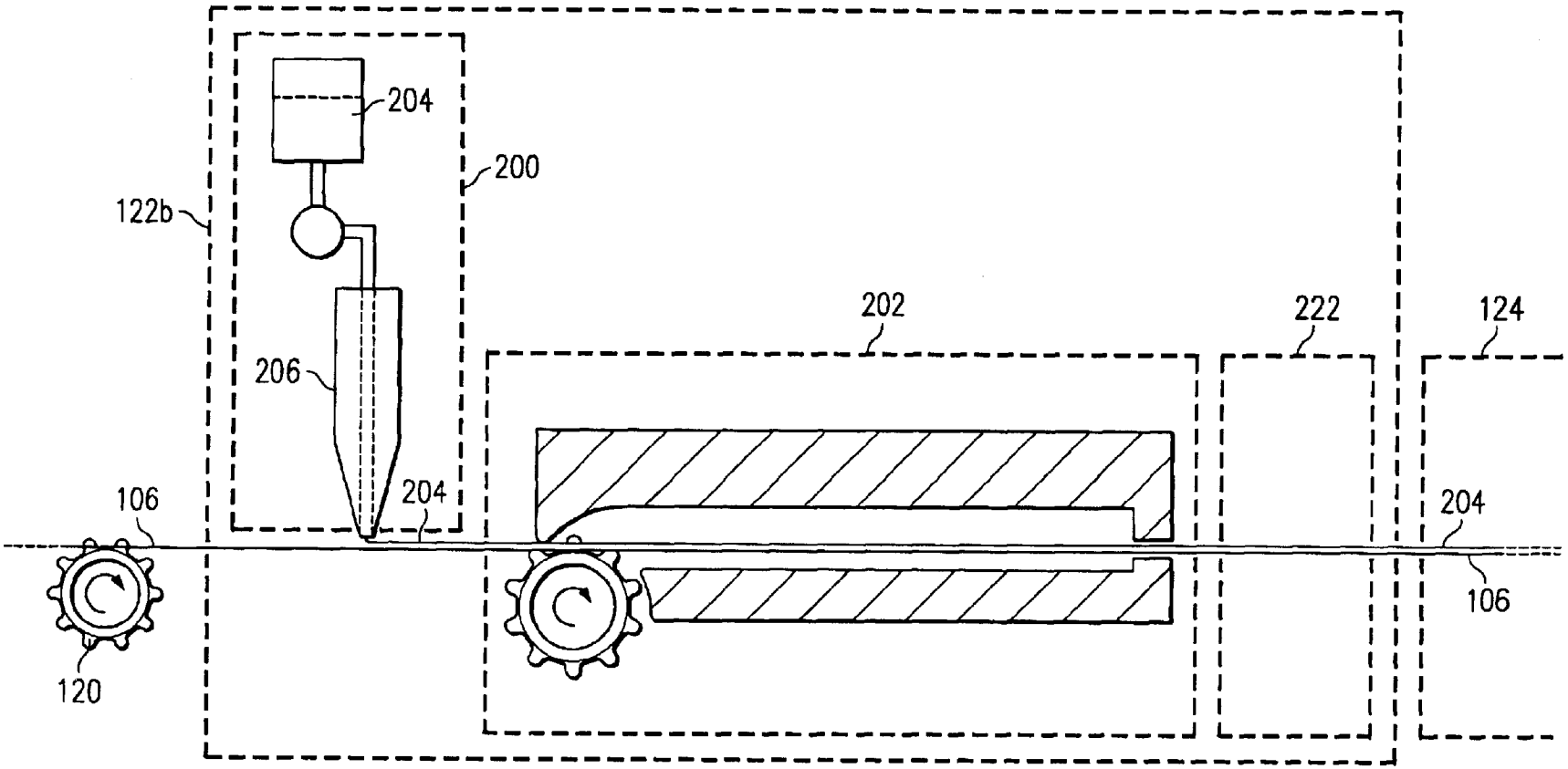
FIG. 2B is a schematic diagram illustrating another embodiment of the development system shown in FIG. 1.
Figures 1, 2B:
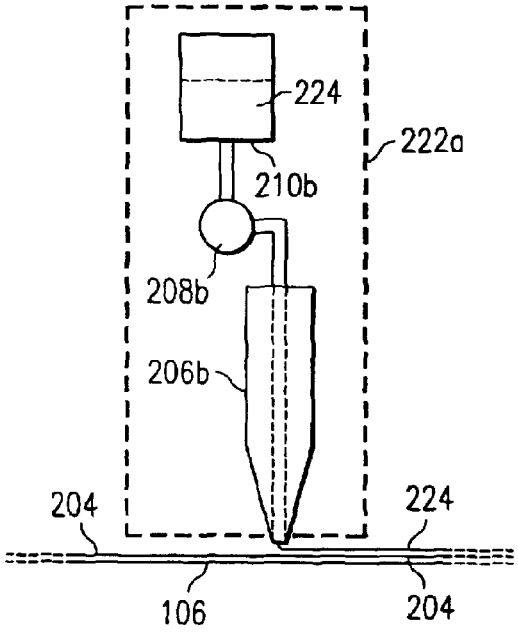
Figures 2, 2B:
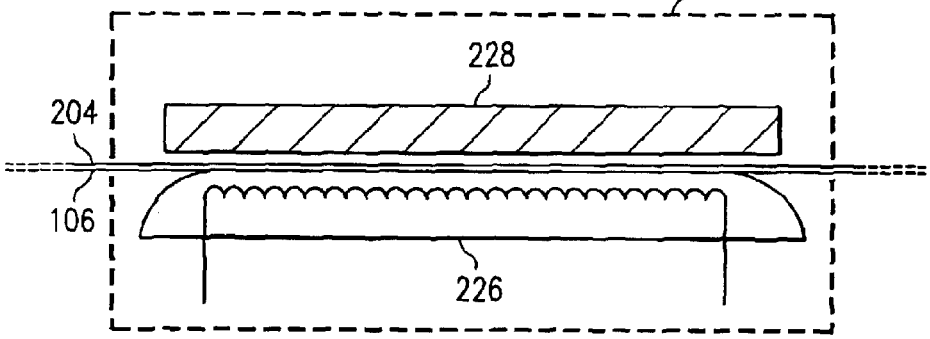

The development system 122 operates to apply a processing solution to the film 106 and develop the film 106 in a controlled atmosphere, as described in greater detail in FIG. 2. One or more types of processing solution may be used, depending upon the configuration of the development system 122. In general, a developer solution is first coated onto the film 106 to develop the film 106. The coated film 106 is transported through a developer station that controls the developing conditions of the film 106. The developer chemically interacts with the chemicals within the film 106 to produce dye clouds and the metallic silver grains within the film 106. Additional processing solutions may also be applied to the film 106. For example, stop solutions, inhibitors, accelerators, bleach solutions, fixer solutions, and the like, may be applied to the film 106.

Figures 2, 2B, 3:
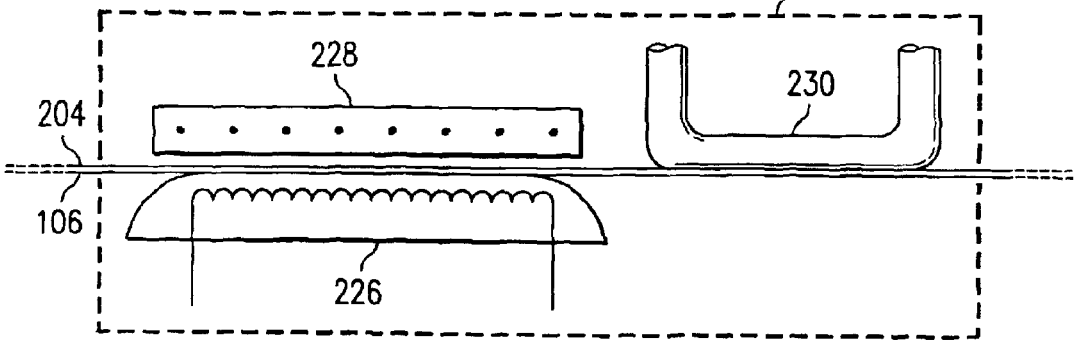

The scanning system 124 scans the film 106 through the processing solutions applied to the film 106, as described in greater detail in FIG. 3. In other words, the processing solutions are not removed from the film 106 prior to the scanning process. In contrast, conventional film processing systems remove the elemental silver and silver halide from the film, as well as the processing solutions to create a conventional film negative prior to any digitization process. The scanning station 124 may be configured to scan the film 106 using any form or combination of electromagnetic energy, referred to generically herein as light. In the preferred embodiment, the film 106 is scanned with light within the visible portion of the electromagnetic spectrum. A disadvantage of scanning with visible light is that any remaining silver halide within the film 106 will react with the light and fog the film 106. The visible light allows the density of the dye clouds to be measured, as well as any silver halide and/or elemental silver remaining in the film 106. In particular, one or more bands of visible light may be used to scan the film 106. For example, the film 106 may be scanned using visible light within the red, green and/or blue portions of the electromagnetic radiation spectrum. The film 106 may also be scanned using infrared light. The dye clouds within the film 106 are transparent to infrared light, but any elemental silver and/or silver halide is not transparent to infrared light. In addition, infrared light does not substantially fog the film. As a result, the infrared light allows the density of any remaining elemental silver and/or silver halide within the film 106 to be measured without damaging the film 106. In at least one embodiment, a satisfactory digital image 108 has been obtained by scanning the film 106 with solely infrared light. In an embodiment in which visible light and infrared light is used, the infrared light allows any elemental silver and/or silver halide to be compensated for by the image processing software 114. In contrast, conventional film processing systems remove substantially all the silver, both silver halide and elemental silver, from the film 106 prior to drying the film and conventionally scanning the film.

In operation, exposed, but undeveloped film 106 is fed into the transport system 120. The film 106 is transported through the development system 122. The development system 122 applies a processing solution to the film 106 that develops the film 106 in a controlled gaseous environment. In other words, the film 106 is not immersed into a tank of processing solutions during the chemical reaction. As a result, the processing of the film 106 does not result in contamination of the tank and the production of harmful effluents. The transport system 120 moves the developed film 106 through the scanning system 124. The scanning system 124 scans the film 106 and produces sensor data 116. The sensor data 116 represents the images on the film 106 at each pixel. The sensor data 116 is communicated to data processing system 102. The data processing system 102 processes the sensor data 16 using image processing software 114 to produce the digital image 108. The data processing system 102 may also operate to enhance of otherwise modify the digital image 108. The data processing system 102 communicates the digital image 108 to the output device 110 for viewing, storage, printing, communicating, or any combination of the above.

In a particular embodiment of the improved film processing system 100 the improved film processing system 100 is configured as a self-service film processing system, such as a kiosk. Such a self-service film processing system is uniquely suited to new locations because no plumbing is required to operate the self service film processing system. In addition, the digital images 108 can be prescreened by the user before they are printed, thereby reducing costs and improving user satisfaction. In addition, the self-service film processing system can be packaged in a relatively small size to reduce the amount of floor space required. As a result of these advantages, a self-service film processing system can be located in hotels, college dorms, airports, copy centers, or any other suitable location. In other embodiments, the improved film processing system 100 may be used for commercial film lab processing applications. Again, because there is no plumbing and the environmental impact of processing the film 106 is substantially reduced or eliminated, the installation cost and the legal liability for operating such a film lab is reduced. The improved film processing system 100 can be adapted to any suitable application without departing from the scope and spirit of the invention.

FIG. 2A illustrates one embodiment of a development system 122. In this embodiment, a development system 122a comprises an applicator station 200 and a development station 202. The applicator station 200 operates to coat a processing solution 204 onto the film 106. The initial processing solution 204 applied to the film 106 is generally includes a color developer solution, such as FLEXICOLOR™ Developer for Process C-41 available from the Eastman Kodak Company. In other embodiments, the processing solution 204 may comprises other suitable solutions. For example, the processing solution 204 may comprise a monobath solution that acts as a developer and stop solution.

In the preferred embodiment, the applicator station 200 includes an applicator 206, a fluid delivery system 208, and a reservoir 210. The applicator 206 operates to coat the film 106 with a thin even layer of processing solution 204. The preferred embodiment of the applicator 206 comprises a slot coater device. In alternative embodiments, the applicator 206 comprises an ink jet applicator, a tank, an aerosol applicator, drip applicator, or any other suitable device for applying the processing solution 204 to the film 106. The fluid delivery system 208 delivers the processing solution 204 from the reservoir 210 to the applicator 206. In an embodiment in which the applicator 206 comprises a slot coater device, the fluid delivery system 208 generally delivers the processing solution 204 at a constant volumetric flow rate to help insure uniformity of coating of processing solution 204 on the film 106. The reservoir 210 contains a sufficient volume of processing solution 204 to process multiple rolls of film 106. In the preferred embodiment, the reservoir 210 comprises a replaceable cartridge. In other embodiments, the reservoir 210 comprises a refillable tank. The applicator station 200 may comprise other suitable systems and devices for applying the processing solution 204 to the film 106. For example, the applicator station 200 may comprise a tank filled with processing solution 204 in which the film 106 is transported through the tank, effectively dipping the film 106 into the processing solution 204.

The development station 202 operates to develop the coated film within a controlled air environment. As used herein, air refers generally to a gaseous environment, which may include a nitrogen environment or any other suitable gaseous environment. It has been discovered that in an air environment, the temperature of the developing film 106 strongly affects the development of the film 106. Conventional development stations do not precisely control the temperature and/or humidity surrounding the film during development. As a result, film developed using conventional development stations develops unevenly and the resulting image is overexposed in areas where the temperature was highest and underexposed in areas where the temperature was coolest. Testing has also showed that the humidity surrounding the film 106 affects the development of the film 106. This is believed to be due to the cooling effect of the processing solution evaporating from the film 106, thereby causing unpredictable and uneven temperature gradients across the film 106. Again, conventional development stations do not control the humidity surrounding the film during development.

In the preferred embodiment, the development station 202 includes a heating system 212. The heating system 212 operates to heat, or maintain the temperature, of the film 106. In a particular embodiment, the film 106 is heated and/or maintained at a temperature within the range of 40–80 degrees Centigrade. In the preferred embodiment, the coated film 106 is heated and/or maintained at a temperature within the range of 45–55 degrees Centigrade, and more preferably at approximately 50 degrees Centigrade. The specific temperature is not as important as consistently maintaining a repeatable temperature profile during the development process. In one embodiment, the temperature is maintained within profile by +/−5 degrees Centigrade. In the preferred embodiment, the temperature is maintained within profile by +/−1 degree Centigrade, and more preferably within +/−0.2 degrees Centigrade. It should be understood that the temperature and temperature profile may comprise any suitable temperature and temperature profile without departing from the scope of the present invention.

In a particular embodiment, the heating system 212 includes multiple individual heating elements that allow the temperature of the heating system 212 to be varied during development. In this embodiment, the temperature of the developing film 106 can be varied to optimize the development of the film 106. For example, infrared light and sensors may be used to monitor the development of the film 106. Based on the sensor readings, the heating system 212 can increase or decrease the temperature of the developing film 106 to compensate for the effects of temperature, type of film, film manufacturer, or other processing variable.

In one embodiment, the heating system 212 contacts the film 106 on the side opposite the coating of processing solution 204. Because of the physical contact between the film 106 and the heating system 212, i.e., conductive heat transfer, the film 106 can be efficiently heated so that evaporation, or humidity, will not substantially effect the processing of the film 106. As a result, a housing forming a development tunnel, as described in greater detail below, is not required, but may be used to further control the development process. In a particular embodiment, the heating system 212 includes a heated roller 212*a* and a heating element 212*b*. In the embodiment illustrated, the heated roller 212*a* heats the film 106 as the processing solution 204 is applied to the film 106 and the heating element 212*b* maintains the temperature of the coated film 106 during development.

In another embodiment, the development station 202 includes a development tunnel 214. The development tunnel 214 comprises a housing 216 that forms a development chamber 218 through which the coated film 106 is transported. The development chamber 218 preferably forms a minimum volume surrounding the coated film 106. The development tunnel 214 is preferably shaped and disposed such that air circulation through the development chamber 218 is minimized. In particular, the development chamber 218 is preferably oriented horizontally to reduce chimney effects, i.e., hot air rising. In addition, the housing forms an entry and exit having in the development chamber 218 having a minimum cross section to reduce circulation of air through the development chamber 218.

In the preferred embodiment, the housing 216 is insulated. As a result, the development tunnel 214 does not necessarily require a heating system 212. However, in the preferred embodiment, the development tunnel 214 includes a heating system 212 to heat and/or maintain the temperature of the coated film 106. In this embodiment, the heating system 212 does not necessarily contact the coated film 106 within the development tunnel 214. For example, the heating system 212 may comprise a heating element 212*b* located within the development tunnel 214 to heat and/or maintain the temperature of the film 106. The heating system 212 may also comprise a forced air heating system that forces heated air through the development tunnel 214.

The humidity surrounding the coated film 106 is also preferably controlled. As discussed above, evaporation of the processing solution 204 from the film 106 can negatively effect the consistent development or processing of the film 106. In one embodiment, the humidity is maintained within a range of 80 to 100 percent humidity, and preferably within a range of 95 to 100 percent humidity, and more preferably at approximately 100 percent humidity. The humidity is preferably controlled within the development chamber 218. The minimum volume of the development chamber 218 facilitates controlling the humidity. As discussed above, the preferred embodiment of the transport system 120 comprises a leader transport system. In this embodiment, the processing solution 204 can be applied to the film leader. This allows the evaporation of the processing solution 204 on the film leader to saturate and stabilize the humidity within the development chamber 218. In another embodiment, the humidity is controlled by a humidification system 220. In a particular embodiment, the humidification system 220 comprises a wicking system that uses a water reservoir to supply humidity to the development chamber 218. The humidification system 220 may comprise other suitable devices or systems for supplying humidity to the development chamber 218. For example, the humidification system 220 may comprise a jet that injects an atomized spray of water into the development chamber 218. The humidification system 220 may also operate to reduce the humidity within the development chamber 218. Too much humidity within the development chamber 218 can result in pooling of water within the development chamber 218, which can negatively affect development and scanning of the film 106.

The development station 202 may also include a control system to monitor and control the temperature and humidity within the development chamber 214. The development station 202 is also light sealed to prevent external light and light from the scanning station 204 from exposing the film 106. The development station 202 may include other suitable devices and systems without departing from the scope of the present invention. For example, the development station 202 is described in terms of a developer solution, but is also applicable to other processing solutions, such as a fix solution, bleach solution, blix solution, halt solution, and the like.

Figures 2, 2B, 3, 4:
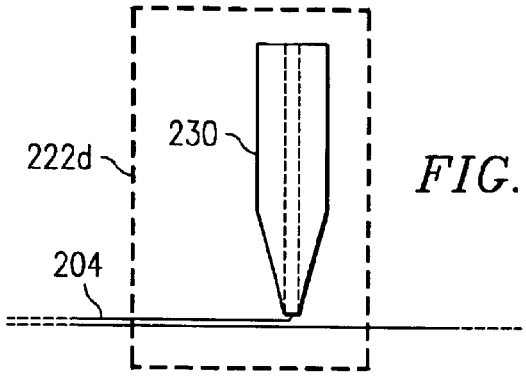
Figure 3:
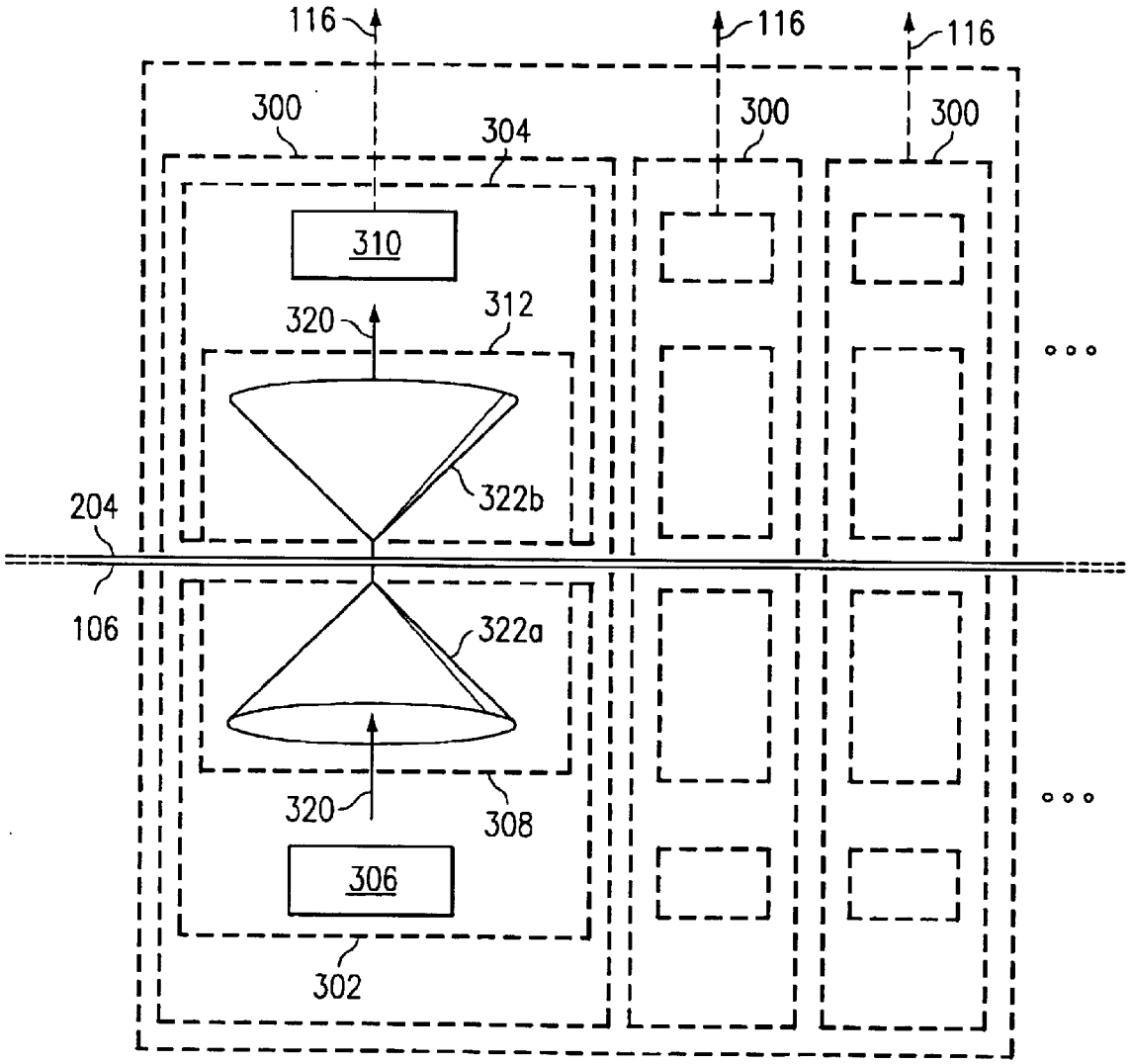

In operation, transport system 120 transports the film 106 through the applicator station 200. Fluid delivery system 208 dispenses the processing solution 204 from the reservoir 210 through the applicator 206 onto the film 106. The processing solution 204 initiates development of the film 106. The coated film 106 is then transported through the development tunnel 214 of the development station 202. The development tunnel 214 operates to give the film 106 time to develop within a controlled temperature and humidity environment within the development chamber 218. Upon development, the coated film 106 is transported by the transport system 120 to the scanning system 124. FIG. 2B illustrates an alternative development system 122*b*. In this embodiment, the development system 122*b* comprises an applicator station 200, a development station 202, and a halt station 222. The developer applicator station 200 and the development station 202 were previously discussed in FIG. 2A. The applicator station 200 again applies the processing solution 204 to the film 106 that initiates development of the film 106. The development station 202 maintains a controlled environment around the film 106 during development of the film 106. Halt station 222 operates to retard or substantially stop the continued development of the film 106. Retarding or substantially stopping the continued development of the film 106 increases the amount of time the film 106 can be exposed to visible light without fogging of the film 106. As discussed in greater detail below, the film 106 is preferably scanned using visible light, and increasing the time the film 106 can be scanned without negatively affecting the film 106 may be advantageous in some embodiments of the improved film processing system 100. FIGS. 2B-1–2B4 illustrate different examples of the halt station 222.

FIG. 2B-1 illustrates a halt station 222*a* that operates to apply at least one halt solution 224 to the film 106 coated with processing solution 204. The halt solution 224 retards or substantially stops the continued development of the film 106. In the embodiment illustrated, the halt station 222*a* comprises an applicator 206*b*, a fluid delivery system 208*b*, and a reservoir 210*b*, similar in function and design as described in FIG. 2A. Although a single applicator 206*b*, fluid delivery system 208*b*, and reservoir 210*b* are illustrated, the halt station 222*a* may comprise any number of applicators 206*b*, fluid delivery systems 208*b*, and reservoirs 210*b* that apply other suitable halt solutions 224 and other suitable solutions.

In one embodiment, the halt solution 224 comprises a bleach solution. In this embodiment, the bleach solution substantially oxidizes the metallic silver grains forming the silver image into a silver compound, which may improve the transmission of light through the film 106 during the scanning operation. In another embodiment, the halt solution 224 comprises a fixer solution. In this embodiment, the fixer solution substantially dissolves the silver halide, which can also improve the transmission of light through the film 106. In yet another embodiment, multiple halt solutions 224 are applied to the film 106. For example, a fixer solution can be applied to the film 106 and then a stabilizer solution can be applied to the film 106. In this example, the addition of the stabilizer desensitizes the silver halide within the film 106 and may allow the film 106 to be stored for long periods of time without sensitivity to light. In order to apply multiple halt solutions, the halt station 222*a* may include multiple applicators 206*b* to apply the different halt solutions 224 to the film 106. The halt solution 224 may comprise any other suitable processing solution. For example, the halt solution 224 may comprise an aqueous solution, a blix solution (mixture of bleach and fix solutions), a stop solution, or any other suitable solution or combination of processing solutions for retarding or substantially stopping the continued development of the film 106.

FIG. 2B-2 illustrates a halt station 222*b* that operates to chill the developing film 106. Chilling the developing film 106 substantially slows the chemical developing action of the processing solution 204. In the embodiment illustrated, the chill station 222*b* comprises an electrical cooling plate 226 and insulation shield 228. In this embodiment, the cooling plate 226 is electronically maintained at a cool temperature that substantially arrests the chemical reaction of the processing solution 204. The insulation shield 228 substantially reduces the heat transfer to the cooling plate 226. The chill halt station 222*b* may comprise any other suitable system and device for chilling the developing film 106.

FIG. 2B-3 illustrates a halt station 222*c* that operates to dry the processing solution 204 on the coated film 106. Drying the processing solution 204 substantially stops further development of the film 106. In the embodiment illustrated, the halt station 222*c* comprises an optional cooling plate 226, as described in FIG. 2B-2, and a drying system 228. Although heating the coated film 106 would facilitate drying the processing solution 204, the higher temperature would also have the effect of accelerating the chemical reaction of the processing solution 204 and film 106. Accordingly, in the preferred embodiment, the film 106 is cooled to retard the chemical action of the processing solution 204 and then dried to effectively freeze-dry the coated film 106. Although chilling the film 106 is preferred, heating the film 106 to dry the film 106 can also be accomplished by incorporating the accelerated action of the developer solution 204 into the development time for the film 106. In another embodiment in which a suitable halt solution 224 is applied to the film 106, the chemical action of the processing solution 204 is already minimized and the film 106 can be dried using heat without substantially effecting the development of the film 106. As illustrated, the drying system 228 circulates air over the film 106 to dry the processing solution 204 and depending upon the embodiment, the halt solution 224. The halt station 222*c* may comprise any other suitable system for drying the film 106.

FIG. 2B-4 illustrates a halt station 222*d* that operates to substantially remove excess processing solution 204, and any excess halt solution 224, from the film 106. The halt station 222*d* does not remove the solutions 204, 224 that are absorbed into the film 106. In other words, even after the wiping action, the film 106 includes some solution 204, 224. Removing any excess processing solution 204 will retard the continued development of the film 106. In addition, wiping any excess solutions 204, 224 from the film 106 may improve the light reflectance and transmissivity properties of the coated film 106. In particular, removal of the excess solutions 204, 224 may reduce any surface irregularities in the coating surface, which can degrade the scanning operations described in detail in FIGS. 3 and 4. In the embodiment illustrated, the halt station 222*d* comprises a wiper 230 operable to substantially remove excess processing solution 204 and any halt solution 224. In a particular embodiment, the wiper 230 includes an absorbent material that wicks away the excess solutions 204, 224. In another embodiment, the wiper 230 comprises a squeegee that mechanically removes the substantially all the excess solutions 204, 224. The halt station 222*d* may comprise any suitable device or system operable to substantially remove any excess solutions 204, 224.

Although specific embodiments of the halt station 222 have been described above, the halt station 222 may comprise any suitable device or system for retarding or substantially stopping the continued development of the film 106. In particular, the halt station 222 may comprise any suitable combination of the above embodiments. For example, the halt station 222 may comprise an applicator 206*b* for applying a halt solution 224, a cooling plate 226, and a drying system 228. As another example, the halt station 222 may comprise a wiper 230 and a drying system 228.

FIG. 3 is a diagram of the scanning system 124. Scanning system 124 comprises one or more scanning stations 300. Individual scanning stations 300 may have the same or different architectures and embodiments. Each scanning station 300 comprises a lighting system 302 and a sensor system 304. The lighting system 302 includes one or more light sources 306 and optional optics 308. The sensor system 304 includes one or more detectors 310 and optional optics 312. In operation, the lighting system 302 operates to produce suitable light 320 that is directed onto the film 106. The sensor system 304 operates to measure the light 320 from the film 106 and produce sensor data 116 that is communicated to the to the data processing system 102.

Each scanning station 300 utilizes electromagnetic radiation, i.e., light, to scan the film 106. Individual scanning stations 300 may have different architectures and scan the film 106 using different colors, or frequency bands, and color combinations. In particular, different colors of light interact differently with the film 106. Visible light interacts with the dye image and any elemental silver and/or silver halide within the film 106. Whereas, infrared light interacts with any elemental silver and/or silver halide, but the dye image is generally transparent to infrared light. The term "color" is used to generally describe specific frequency bands of electromagnetic radiation, including visible and non-visible light.

Visible light, as used herein, means electromagnetic radiation having a frequency or frequency band generally within the electromagnetic spectrum of near infrared light (>700 nm) to near ultraviolet light (<400 nm). Visible light can be further separated into specific bandwidths. For example, the color red is generally associated with light within a frequency band of approximately 600 nm to 700 nm, the color green is generally associated with light within a frequency band of approximately 500 nm to 600 nm, and the color blue is generally associated with light within a frequency band of approximately 400 nm to 500 nm. Near infrared light is generally associated with radiation within a frequency band of approximately 700 nm to 1500 nm. Although specific colors and frequency bands are described herein, the scanning station 300 may utilize other suitable colors and frequency ranges without departing from the spirit and scope of the invention.

The light source 306 may comprise one or more devices or system that produces suitable light 320. In the preferred embodiment, the light source 306 comprises an array of light-emitting diodes (LEDs). In this embodiment, different LEDs within the array may be used to produce different colors of light 320, including infrared light. In particular, specific colors of LEDs can be controlled to produce short duration pulses of light 320. In another embodiment, the light source 306 comprises a broad spectrum light source 306, such as a xenon, fluorescent, incandescent, tungsten-halogen, direct gas discharge lamps, and the like. In this embodiment, the sensor system 304 may include filters for spectrally separating the colors of light 320 from the film 106. For example, as described below, a RGB filtered trilinear array of detectors may be used to spectrally separate the light 320 from the film 106. In another embodiment of a broad-spectrum light source, the light source 306 includes a filter, such as a color wheel, to produce the specified colors of light 320. In another embodiment, the light is filtered into specific bands after the light has interacted with the film 106. For example, a hot or cold mirror can be used to separate the infrared light from the visible light. The visible light can then be separated into its constituent colors to produce sensor data 116. In yet another embodiment, the light source 306 comprises a point light source, such as a laser. For example, the point light source may be a gallium arsenide or an indium gallium phosphide laser. In this embodiment, the width of the laser beam is preferably the same size as a pixel on the film 106 (~12 microns). Filters, such as a color wheel, or other suitable wavelength modifiers or limiters maybe used to provide the specified color or colors of light 320.

Optional optics 308 for the lighting system 302 directs the light 320 to the film 106. In the preferred embodiment, the optics 308 comprises a waveguide that directs the light 320 onto the film 106. In other embodiment, the optics 320 includes a lens system for focusing the light 320. In a particular embodiment, the lens system includes a polarizing filter to condition the light 320. The optics 308 may also include a light baffle 322*a*. The light baffle 322*a* constrains illumination of the light 320 within a scan area in order to reduce light leakage that could cause fogging of the film 106. In one embodiment, the light baffle 322*a* comprises a coated member adjacent the film 106. The coating is generally a light absorbing material to prevent reflecting light 320 that could cause fogging of the film 106.

The detector 310 comprises one or more photodetectors that convert light 320 from the film 106 into data signals 116. In the preferred embodiment, the detector 310 comprises a linear charge coupled device (CCD) array. In another embodiment, the detector 310 comprises an area array. The detector 310 may also comprise a photodiode, phototransistor, photoresistor, and the like. The detector 310 may include filters to limit the bandwidth, or color, detected by individual photodetectors. For example, a trilinear array often includes separate lines of photodetectors with each line of photodetectors having a color filter to allow only one color of light to be measured by the photodetector. Specifically, in a trilinear array, the array generally includes individual red, green, and blue filters over separate lines in the array. This allows the simultaneous measurement of red, green, and blue components of the light 320. Other suitable types of filters may be used. For example, a hot mirror and a cold mirror can be used to separate infrared light from visible light.

Optional optics 312 for the sensor system 304 directs the light 320 from the film 106 onto the detector 310. In the preferred embodiment, the optics 312 comprises lens system that directs the light 320 from the film 106 onto the detector 310. In a particular embodiment, the optics 312 include polarized lenses. The optics 312 may also include a light baffle 322*b*. The light baffle 322*b* is similar in function to light baffle 322*a* to help prevent fogging of the film 106.

As discussed previously, individual scanning stations 300 may have different architectures. For example, light 320 sensed by the sensor system 304 may be transmitted light or reflected light. Light 320 reflected from the film 106 is generally representative of the emulsion layer on the same side of the film 106 as the sensor system 304. Specifically, light 320 reflected from the front side (emulsion side) of the film 106 represents the blue sensitive layer and light 320 reflected from the back side of the film 106 represents the red sensitive layer. Light 320 transmitted through the film 106 collects information from all layers of the film 106. Different colors of light 320 are used to measure different characteristics of the film 106. For example, visible light interacts with the dye image and silver within the film 106, and infrared light interacts with the silver in the film 106.

Different architectures and embodiments of the scanning station 300 may scan the film 106 differently. In particular, the lighting system 302 and sensor system 304 operate in concert to illuminate and sense the light 320 from the film 106 to produce suitable sensor data 116. In one embodiment, the lighting system 302 separately applies distinct colors of light 320 to the film 106. In this embodiment, the sensor system 304 generally comprises a non-filtered detector 310 that measures in series the corresponding colors of light 320 from the film 106. In another embodiment, multiple unique color combinations are simultaneously applied to the film 106, and individual color records are derived from the sensor data 116. In another embodiment, the lighting system 302 simultaneously applies multiple colors of light 320 to the film 106. In this embodiment, the sensor system 304 generally comprises a filtered detector 310 that allows the simultaneous measurement of individual colors of light 320. Other suitable scanning methods may be used to obtain the required color records.

The use of the halt station 222 may improve the scanning properties of the film 106 in addition to retarding or substantially stopping the continued development of the film 106. For example, the intensity of light 320 transmitted through the film 106 may be partially blocked, or occluded, by the silver within the film 106. In particular, both the silver image and silver halide within the film 106 occlude light 320. On the whole, the silver image within the film 106 absorbs light 320, and the silver halide reflects light 320. The halt solutions 224 may be used to improve the scanning properties of the film 106. For example, applying a bleach solution to the film 106 reduces the optical density of the silver image within the film 106. Applying a fixer solution to the film 106 reduces optical density of silver halide within the film 106. Another method for improving the scanning properties of the film 106 is drying the film 106. Drying the film 106 improves the clarity of the film 106.

As described above, the scanning system 124 may include one or more individual scanning stations 300. Specific examples of scanner station 300 architectures are illustrated in FIGS. 4A–4D. The scanning system 124 may comprise any illustrated example, combination of examples, or other suitable method or system for scanning the film 106.

Figure 4A:
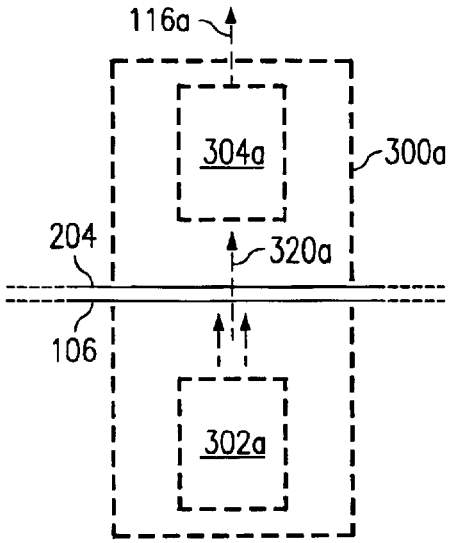
FIGS. 4A–4D are schematic diagrams illustrating various embodiments of a scanning station shown in FIG. 3.

FIG. 4A is a schematic diagram illustrating a scanning station 300*a* having a transmission architecture. As illustrated, the transmission scanning station 300*a* comprises a lighting system 302*a* and a sensor system 304*a*. Lighting system 302*a* produces light 320*a* that is transmitted through the film 106 and measured by the sensor system 304*a*. The sensor system 304*a* produces sensor data 11 6*a* that is communicated to the data processing system 102. Lighting system 302*a* and sensor system 304*a* are similar in design and function as lighting system 302 and sensor system 304, respectively. Although FIG. 4A illustrates the light 320*a* being transmitted through the film 106 from the backside to the frontside of the film 106, the light 320*a* can also be transmitted through the film 106 from the frontside to the backside of the film 106 without departing from the scope of the invention.

In the preferred embodiment of the scanning station 300*a*, the light 320*a* produced by the lighting system 302*a* comprises visible light. The visible light 320*a* may comprise broadband visible light, individual visible light colors, or combinations of visible light colors. The visible light 320*a* interacts with any elemental silver and/or silver halide and at least one dye cloud within the film 106.

In an embodiment in which the visible light 320*a* interacts with the magenta, cyan and yellow dye images within the film 106, as well as elemental silver and/or silver halide within the film 106. The sensor system 304*a* records the intensity of visible light 320*a* from the film 106 and produces sensor data 116*a*. The sensor data 116*a* generally comprises a red, green, and blue record corresponding to the magenta, cyan, and yellow dye images. Each of the red, green, and blue records includes a silver record. As previously discussed, the elemental silver and/or silver halide partially blocks the visible light 320*a* being transmitted through the film 106. Accordingly, the red, green, and blue records are generally processed by the data processing system 102 to correct the records for the blockage caused by the elemental silver and/or silver halide in the film 106.

In another embodiment of the transmission scanning station 300*a*, the light 320*a* produced by the lighting system 302*a* comprises visible light and infrared light. As discussed above, the visible light may comprise broadband visible light, individual visible light colors, or combinations of visible light colors. The infrared light may comprise infrared, near infrared, or any suitable combination. The visible light 320*a* interacts with the elemental silver and/or silver halide and at least one dye image, i.e. cyan, magenta, or yellow dye images, within the film 106 to produce a red, green, and blue record that includes a silver record. The infrared light interacts with the elemental silver and/or silver halide within the film 106 and produces a silver record. The silver image record can then be used to remove, at least in part, the silver metal record contained in the red, green, and blue records. In this embodiment, the silver is analogous to a defect that obstructs the optical path of the infrared light. The amount of blockage is used as a basis for modifying the color records. For example, in pixels having a high silver density, the individual color records are significantly increased, whereas in pixels having a low silver density, the individual color records are relatively unchanged.

In yet another embodiment of the transmission scanning station 300*a*, the light produced by the lighting system 302*a* comprises infrared or near infrared light. In this embodiment, the infrared light 320*a* interacts with the silver record in the film 106 but does not substantially interact with the dye images within the film 106. In this embodiment, the sensor data 116*a* does not spectrally distinguish the magenta, cyan, and yellow dye images. An advantage of this embodiment is that the infrared light 320*a* does not fog the film 106. In a particular embodiment, the advantage of not fogging the film 106 allows the film 106 to be scanned at multiple development times without negatively affecting the film 106. In this embodiment, the scanning station 300*a* can be used to determine the optimal development time for the film 106. This embodiment may optimally be used to determine the optimal development time of the film 106, which can then be scanned using another scanning station 300

Figure 4B:
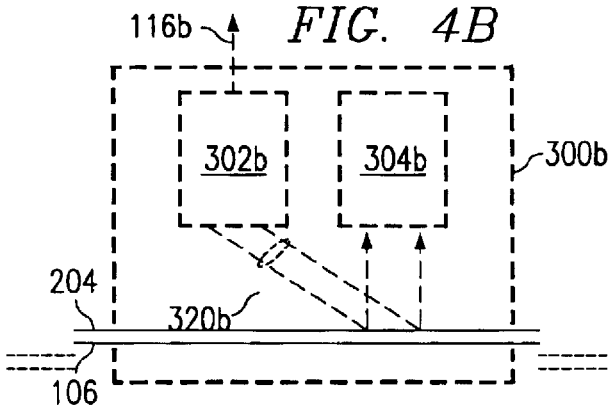

FIG. 4B is a schematic diagram illustrating a scanning station 300*b* having a reflection architecture. The reflective scanning station 300*b* comprises a lighting system 302*b* and a sensor system 304*b*. Lighting system 302*b* produces light 320*b* that is reflected from the film 106 and measured by the sensor system 304*b*. The sensor system 304*b* produces sensor data 116*b* that is communicated to the data processing system 102. Lighting system 302*b* and sensor system 304*b* are similar to lighting system 302 and sensor system 304, respectively.

In one embodiment of the reflective scanning station 300*b* used to scan the blue emulsion layer of the film 106, the light 320*b* produced by the lighting system 302*b* comprises blue light. In this embodiment, the blue light 320*b* scans the elemental silver and/or silver halide and dye image within the blue layer of the film 106. The blue light 320*b* interacts with the yellow dye image and also the elemental silver and/or silver halide in the blue emulsion layer. In particular, the blue light 320*b* is reflected from the silver halide and measured by the sensor system 304*b* to produce a blue record. Many conventional films 106 include a yellow filter below the blue emulsion layer that blocks the blue light 320*a* from illuminating the other emulsion layers of the film 106. As a result, noise created by cross-talk between the blue emulsion layer and the red and green emulsion layers is substantially reduced.

In another embodiment of the reflective scanning station 300*b* used to scan the blue emulsion layer of the film 106, the light 320*b* produced by the lighting system 302*b* comprises non-blue light. It has been determined that visible light other than blue light interacts in substantially the same manner with the various emulsion layers. In this embodiment, infrared light also interacts in substantially the same manner as non-blue light, with the exception that infrared light will not fog the emulsion layers of the film 106. In this embodiment, the non-blue light 320*b* interacts with the elemental silver and/or silver halide in the blue emulsion layer of the film 106, but is transparent to the yellow dye within the blue emulsion layer of the film 106. This embodiment is prone to higher noise levels created by cross-talk between the blue and green emulsion layers of the film 106.

In yet another embodiment of the reflective scanning station 300*b*, the light 320*b* produced by the lighting system 302*b* comprises visible and infrared light. In this embodiment, blue light interacts with the yellow dye image and the elemental silver and/or silver halide in the blue emulsion layer, green light interacts with magenta dye image and the silver in the green emulsion layer, red light interacts with the cyan dye image and the silver in the red emulsion layer, and the infrared light interacts with the silver in each emulsion layer of the film 106. In this embodiment, the sensor system 304*b* generally comprises a filtered detector 310*b* (not expressly shown) that measures the red, green, blue, and infrared light 320*b* from the film 106 to produce red, green, blue, and infrared records as sensor data 116*b*.

Although the scanning station 300*b* is illustrated with the sensor system 304*b* located on front side of the film 106, the sensor system 304*b* may also be located on the back side of the film 106. In one embodiment, the light 320*b* produced by the lighting system 302*b* may comprise red light. The red light largely interacts with the cyan dye image and silver in the red emulsion layer of the film 106 to produce a red record of the sensor data 116*b*.

Figure 4C:
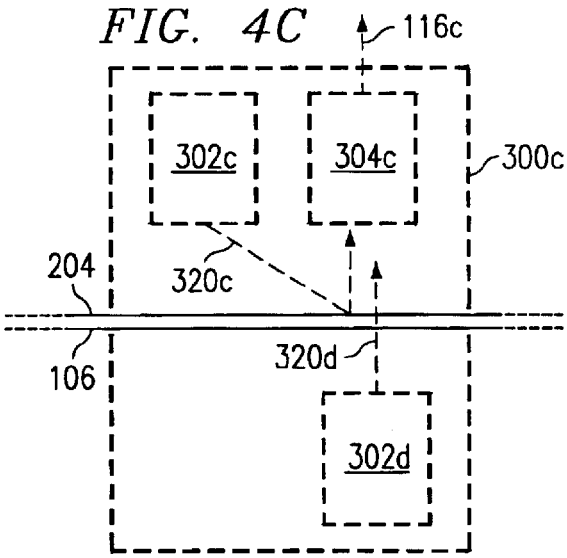

FIG. 4C is a schematic diagram illustrating a scanning station 300*c* having a transmission-reflection architecture. In this embodiment, the scanning station 300*c* comprises a first lighting system 302*c*, a second lighting system 302*d*, and a sensor system 304*c*. In the preferred embodiment, the lighting system 302*c* operates to illuminate the front side of the film 106 with light 320*c*, the second lighting system 302*d* operates to illuminate the backside of the film 106 with light 320*d*, and the sensor system 304*c* operates to measure the light 320*c* reflected from the film 106 and the light 320*d* transmitted through the film 106. Based on the measurements of the light 320*b*, 320*d*, the sensor system 304*c* produces sensor data 116*c* that is communicated to the data processing system 102. Lighting system 302*c* and 302*d* are similar to lighting system 302, and sensor system 304*c* is similar to the sensor system 304. Although scanning station 300*c* is illustrated with lighting systems 302*c*, 302*d*, a single light source may be used to produce light that is directed through a system of mirrors, shutters, filters, and the like, to illuminate the film 106 with the front side of the film 106 with light 320*c* and illuminate the back side of the film 106 with light 320*d*. The light 302*c*, 302*d* may comprise any color or color combinations, including infrared light.

This embodiment of the scanning station 300*c* utilizes many of the positive characteristics of the transmission architecture scanning station 300*a* and the reflection architecture scanning station 300*b*. For example, the blue emulsion layer is viewed better by light 320*c* reflected from the film 106 than by light 320*d* transmitted through the film 106; the green emulsion layer is viewed better by light 320*d* transmitted through the film 106 than by light 320*c* reflected from the film 106; and the red emulsion layer is adequately viewed by light 320*d* transmitted through the film 106. In addition, the cost of the scanning station 300*c* is minimized through the use of a single sensor system 304*c*.

In the preferred embodiment of the scanning station 300*c*, the light 320*c* comprises blue light, and light 320*d* comprises red, green, and infrared light. The blue light 320*c* interacts with the yellow dye image and silver in the blue emulsion layer of the film 106. The sensor system 304*c* measures the light 302*c* from the film 106 and produces a blue-silver record. The red and green light 320*d* interacts with the cyan and magenta dye images, respectively, as well as the silver in the film 106. The infrared light 320*d* interacts with the silver, but does not interact with the dye clouds within the film 106. As discussed previously, the silver contained within the film 106 may comprise silver grains, silver halide, or both. The red, green, and infrared light 320*d* transmitted through the film 106 is measured by the sensor system 304*c*, which produces a red-silver, green-silver, and silver record. The blue-silver, red-silver, green-silver, and silver records form the sensor data 116*c* that is communicated to the data processing system 102. The data processing system 102 utilizes the silver record to facilitate removal of the silver component from the red, green, and blue records.

In another embodiment, the light 320*c* comprises blue light and infrared light, and light 320*d* comprises red, green, and infrared light. As discussed previously, the blue light 320*c* mainly interacts with the yellow dye image and silver within the blue emulsion layer of the film 106. The infrared light 320*c* interacts with mainly the silver in the blue emulsion layer of the film 106. The sensor system 304*c* measures the blue and infrared light 320*c* from the film 106 and produces a blue-silver record and a front side silver record, respectively. The red, green, and infrared light 320*d* interact with the film 106 and are measured by the sensor system 304*c* to produce red-silver, green-silver and transmitted-silver records as discussed above. The blue-silver, red-silver, green-silver, and both silver records form the sensor data 116*c* that is communicated to the data processing system 102. In this embodiment, the data processing system 102 utilizes the front side silver record of the blue emulsion layer to facilitate removal of the silver component from the blue-silver record, and the transmission-silver record is utilized to facilitate removal of the silver component from the red and green records.

Although the scanning station 300*c* is described in terms of specific colors and color combinations of light 320*c* and light 320*d*, the light 320*c* and light 320*d* may comprise other suitable colors and color combinations of light without departing from the scope of the invention. For example, light 320*c* may comprise non-blue light, infrared light, broadband white light, or any other suitable light. Likewise, light 320*d* may include blue light, broadband white light, or another other suitable light. Scanning station 300*c* may also comprise other suitable embodiments without departing from the scope of the invention. For example, although the scanning station 300*c* is illustrated with two lighting systems 302 and a single sensor system 304, the scanning station 300*c* could be configured with a single lighting system 302 and two sensor systems 304, wherein one sensor system measures light 320 reflected from the film 106 and the second sensory system 304 measures light 320 transmitted through the film 106. In addition, as discussed above, the scanning station 300 may comprise a single lighting system that illuminates the film 106 with light 320*c* and light 320*d*.

Figure 4D:
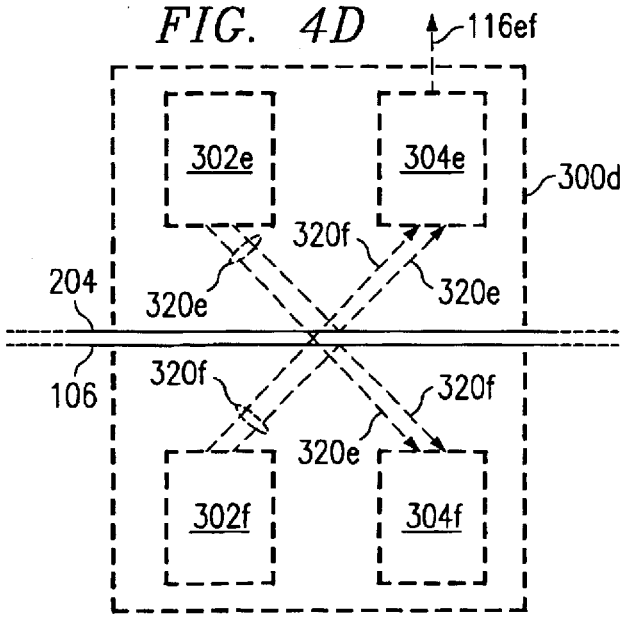

FIG. 4D is a schematic diagram illustrating a scanning station 300*d* having a reflection-transmission-reflection architecture. In this embodiment, the scanning station 300*d* comprises a first lighting system 302*e*, a second lighting system 302*f*, a first sensor system 304*e*, and a second sensor system 304*f*. In the embodiment illustrated, the lighting system 302*e* operates to illuminate the front side of the film 106 with light 320*e*, the second lighting system 302*f* operates to illuminate the back side of the film 106 with light 320*f*, the first sensor system 304*e* operates to measure the light 320*e* reflected from the film 106 and the light 320*f* transmitted through the film 106, and the second sensor system 304*f* operates to measure the light 320*f* reflected from the film 106 and the light 320*e* transmitted through the film 106. Based on the measurements of the light 320*e* and 320*f*, the sensor systems 304*e*, 304*f* produce sensor data 116*ef* that is communicated to the data processing system 102. Lighting systems 302*e*, 302*f* are similar to lighting systems 302, and sensor systems 304*e*, 304*f* are similar to the sensor system 304. Although scanning station 300*d* is illustrated with lighting systems 302, 302*f*, and sensor systems 304*e*, 304*f*, a single lighting system and/or sensory system, respectively, may be used to produce light that is directed through a system of mirrors, shutters, filters, and the like, to illuminate the film 106 with the frontside of the film 106 with light 320*e* and illuminate the backside of the film 106 with light 320*f*.

This embodiment of the scanning station 300*d* expands upon the positive characteristics of the transmission-reflection architecture of scanning station 300*c*. For example, as discussed in reference to FIG. 4C, the blue emulsion layer is viewed better by light 320*e* reflected from the film 106 and the green emulsion layer is viewed better by light 320*e* or 320*f* transmitted through the film 106. Second scanning station 300*f* allows viewing of the red emulsion layer by light 320*f* reflected from the film 106, which generally produces better results than viewing the red emulsion layer by light 320*e* or light 320*f* transmitted through the film 106.

In the preferred embodiment of the scanning station 300*d*, the sensor systems 304*e*, 304*f* include a trilinear array of filtered detectors, and the light 320*c* and the light 320*f* comprises broadband white light and infrared light. The trilinear array operates to simultaneously measure the individual red, green, and blue components of the broadband white light 320*e*, 320*f*. The infrared light is measured separately and can be measured through each filtered detector 310 of the sensor systems 304*e*, 304*f*. The broadband white light 320*e*, 320*f* interacts with the silver and magenta, cyan, and yellow color dyes in the film 106, respectively, and the infrared light 320*e*, 320*f* interacts with the silver within the film 106. The first sensor system 304*e* measures the light 320*e* reflected from the front side of the film 106 and the light 320*f* transmitted through the film 106, and the second sensor system 304*f* measures the light 320*f* reflected from the back side of the film 106 and the light 320*e* transmitted through the film 106. The reflected white light 320*e* measured by the first sensor system 304*e* includes information corresponding to the yellow dye image and the silver in the blue emulsion layer of the film 106. In particular, the blue component of the broadband white light 320*e* measured by the blue detector of the sensor system 304*e* corresponds to the yellow dye image, and the non-blue components of the broadband white light 320*e* measured by the red and green detectors corresponds to the silver within the blue emulsion layer of the film 106. Similarly, the red component of the broadband white light 320*f* measured by the red detector of the sensor system 304*f* corresponds to the cyan dye image, and the non-red components of the broadband white light 320*e* measured by the blue and green detectors corresponds to the silver within the red emulsion layer of the film 106. The white light 320*e*, 320*f* transmitted through the film 106 interacts with each color dye image within the film 106 and the red, green, and blue light components are measured by the red, green, and blue detectors of the sensor systems 304*e*, 304*f* to produce individual red, green and blue light records that include the silver. The infrared light 320*e* reflected from the film 106 and measured by the sensor system 304*e* corresponds to the silver in the blue emulsion layer of the film 106, and the infrared light 320*f* reflected from the film 106 and measured by the sensor system 304*f* corresponds to the silver in the red emulsion layer of the film 106. The infrared light 320*e*, 320*f* transmitted through the film 106 measured by the sensor systems 304*e*, 304*f* corresponds to the silver in the red, green, and blue emulsion layers of the film 106. The individual measurements of the sensor systems 304*e*, 304*f* are communicated to the data processing system 102 as sensor data 116*d*. The data processing system 102 processes the sensor data 116*d* and constructs the digital image 108 using the various sensor system measurements. For example, the blue signal value for each pixel can be calculated using the blue detector data from the reflected light 320*e* and the blue detector data from the transmitted light 320*f*, as modified by non-blue detector data from the reflected light 320*e*, the infrared data from the reflected light 320*e* and the non-blue detector data from the transmitted light 320*f*. The red and green signal values for each pixel can be similarly calculated using the various measurements.

In another embodiment of the scanning station 300*d*, the sensor systems 304*e*, 304*f* include a trilinear array of filtered detectors, and the light 320*e* and the light 320*f* comprises broadband white light. This embodiment of the scanning station 300*d* operates in a similar manner as discussed above, with the exception that infrared light is not measured or used to calculate the digital image 108. Although the scanning station 300*d* is described in terms of a specific colors and color combinations of light 320*e* and light 320*f*, the light 320*e* and light 320*f* may comprise other suitable colors and color combinations of light without departing from the scope of the invention. Likewise, the scanning station 300*d* may comprise other suitable devices and systems without departing from the scope of the invention.

Figure 5A:
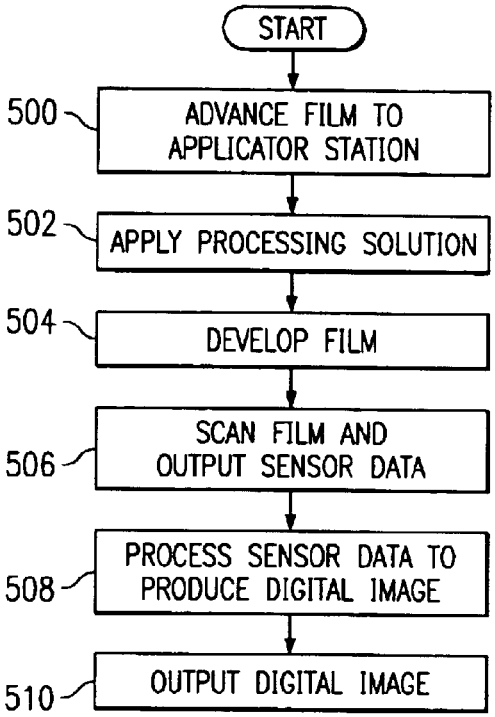
FIGS. 5A–5B are flow charts illustrating various methods of digital color dye film processing in accordance with the invention.

FIG. 5A is a flowchart of one embodiment of a method for developing and processing film. This method may be used in conjunction with one or more embodiments of the improved film processing system 100 that includes a data processing system 102 and a film processing system 104 having a transport system 120, a development system 122, and a scanning system 124. The development system 122 includes an applicator station 200 for applying a processing solution 204 to the film 106 and a development station 202. The scanning system 124 comprises a single scanning station 300 operable to scan the film 106 with light 320 having a frequency within the visible light spectrum and produce sensor data 116 that is communicated to the data processing system 102. The data processing system 102 processes the sensor data 116 to produce a digital image 108 that may be output to an output device 110.

Figure 5B:
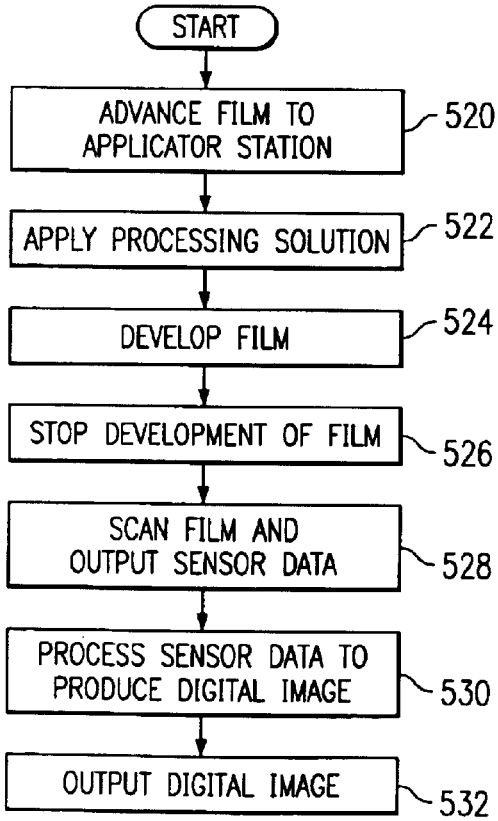

The method begins at step 500, where the transport system 120 advances the film 106 to the applicator station 200. Film 106 is generally fed from a conventional film cartridge and advanced by the transport system 120 through the various stations of the film processing system 104. At step 502, processing solution 204 is applied to the film 106. The processing solution 204 initiates production of silver and at least one dye image within the film 106. The processing solution 204 is generally applied as a thin coating onto the film 106, which is absorbed by the film 106. At step 504, the film 106 is advanced through the development station 202 where the dye images and silver grains develop within the film 106. The environmental conditions, such as the temperature and humidity, are controlled within the development station 202. This allows the film 106 to develop in a controlled and repeatable manner and provides the proper development time for the film 106. At step 506, the film 106 is scanned by the scanning system 124. The light interacts with the film 106 and is sensed by sensor system 304. As discussed in reference to FIGS. 4A–4D, the film 106 can be scanned in a number of different ways embodied in a number of different architectures, each with their own advantages. Sensor data 116 is produced by the scanning system 124 and communicated the data processing system 102. At step 508, the sensor data 116 is processed to produce the digital image 108. The data processing system 102 includes image processing software 114 that processes the sensor data 116 to produce the digital image 108. The digital image 108 represents the photographic image recorded on the film 106. At step 510, the digital image 108 is output to one or more output devices 110, such as monitor 110*a*, printer 110*b*, network system 110*c*, storage device 110*d*, computer system 110*e*, and the like. FIG. 5B is a flowchart of another embodiment of a method for developing and processing film. This method may be used with one or more embodiments of the improved film processing system 100 that includes the development system 122 having the halt station 222. This method is similar to the method described in FIG. 5A, with the exception that development of the film 106 is substantially stopped by the halt station 222. The method begins at step 520, where the transport system 120 advances the film 106 to the applicator station 200. At step 522, processing solution 204 is applied to the film 106. The processing solution 204 initiates production of elemental silver grains and at least one dye image within the film 106. At step 524, the film 106 is advanced through the development station 202 where the film 106 is developed. At step 526, the continued development of the film 106 is retarded or substantially stopped by the halt station 222. Retarding or substantially stopping the continued development of the film 106 allows the film 106 to be scanned using visible light 320 without fogging the film 106 during the scanning process. For example, if the development of the film 106 is stopped, the film 106 can be exposed to visible light without negatively affecting the scanning process. The halt station 222 may comprise a number of embodiments. For example, the halt station 222 may apply a halt solution 232, such as a bleach solution, fixer solution, blix solution, stop solution and the like. The halt solution 232 may also operate to stabilize the film 106. The halt station 222 may also comprise a wiper, drying system, cooling system and the like. At step 528, the film 106 is scanned by the scanning system 124 using light 320 having at least one frequency within the visible portion of the electromagnetic spectrum, i.e., visible light. At step 530, the sensor data 116 is processed to produce the digital image 108. At step 532, the digital image 108 is output to one or more output devices 110, such as monitor 110*a*, printer 110*b*, network system 110*c*, storage device 110*d*, computer system 110*e*, and the like.

While the invention has been particularly shown and described in the foregoing detailed description, it will be understood by those skilled in the art that various other changes in form and detail may be made without departing from the spirit and scope of the invention.

What is claimed is:

1. A development tunnel operable to receive a photographic film coated with a developer solution, the development tunnel comprising a housing forming a development chamber through which the coated film is transported, the development chamber operable to maintain a relatively constant temperature and humidity of the coated film during development of the film.

2. The development tunnel of claim 1, wherein the housing is insulated.

3. The development tunnel of claim 1, further comprising a heating system operable to heat the coated film.

4. The development tunnel of claim 3, wherein the heating system contacts the coated film.

5. The development tunnel of claim 1, wherein the housing substantially surrounds the coated film during the development process.

6. The development tunnel of claim 1, wherein a cross-section of the development chamber is optimized for minimum volume.

7. The development tunnel of claim 1, wherein the development chamber includes an entry and an exit, wherein the entry and exit operable to reduce air flow circulation through the development chamber.

8. The development tunnel of claim 1, wherein the development chamber is oriented horizontally to reduce convective air flow through the development chamber.

9. The development tunnel of claim 1, further comprising a control system operable to monitor and control the temperature within the development chamber.

10. The development tunnel of claim 1, wherein the temperature within the development chamber is maintained substantially within the range of 40–80 degrees centigrade.

11. The development tunnel of claim 10, wherein the temperature within the development chamber is maintained substantially within the range of 45–55 degrees centigrade.

12. The development tunnel of claim 1, wherein the relative humidity within the development chamber is maintained substantially within the range of 80–100 percent relative humidity.

13. The development tunnel of claim 1, wherein humidity is supplied by evaporation of the developer solution on a film leader coupled to the coated film.

14. The development tunnel of claim 1 further comprising a humidification system operable to increase humidity within the development chamber.

15. The development tunnel of claim 1, further comprising a humidification system operable to decrease humidity within the development chamber.

16. The development tunnel of claim 1, further comprising a heating system operable to maintain the temperature of the coated film.

17. The development tunnel of claim 1, wherein the temperature of the film is consistently maintained within 5 degrees Centigrade of a temperature profile.

18. The development tunnel of claim 17, wherein the temperature of the film is consistently maintained within 1 degree Centigrade of a temperature profile.

19. A photographic film processing system comprising:

an applicator station operable to coat a developer solution onto a photographic film;

a development station operable to receive the coated photographic film, wherein the development station operates to heat coated photographic film in an air environment; and a transport system operable to transport the film.

20. The photographic film processing system of claim 19, wherein the applicator station includes a replaceable developer cartridge having a reservoir of developer solution disposed within the cartridge.

21. The photographic film processing system of claim 19, wherein the applicator station includes a slot coater device operable to apply a relatively smooth layer of developer solution onto the photographic film.

22. The photographic film processing system of claim 19, further comprising a scanning station operable to scan the photographic film and produce digital images.

23. The photographic film processing system of claim 22, wherein the scanning station scans the photographic film coated with developer solution.

24. The photographic film processing system of claim 22, further comprising a print station operable to print one or more digital images.

25. The photographic film processing system of claim 22, further comprising a user interface operable to display the digital images.

26. The photographic film processing system of claim 22, wherein the digital images can be electronically communicated to a computer network.

27. The photographic film processing system of claim 19, wherein the development station includes a heating system operable to contact the coated photographic film.

28. The photographic film processing system of claim 19, wherein the development station includes a development tunnel having a housing that forms a development chamber through which the coated film is transported, the development chamber operable to maintain a relatively constant temperature and humidity of the coated film during development of the film.

29. The photographic film processing system of claim 28, wherein the housing is insulated.

30. The photographic film processing system of claim 28, wherein the development tunnel further comprises a heating system operable to heat the coated photographic film.

31. The photographic film processing system of claim 30, wherein the heating system contacts the coated photographic film.

32. The photographic film processing system of claim 30, wherein the temperature within the development chamber is maintained substantially within the range of 40–80 degrees Centigrade.

33. The photographic film processing system of claim 30, wherein the temperature within the development chamber is maintained substantially within the range of 45–60 degrees Centigrade.

34. The photographic film processing system of claim 28, wherein the transport system comprises a leader transport system and the developer solution is coated onto a film leader to produce humidity within the development chamber.

35. The photographic film processing system of claim 28, wherein the relative humidity within the development chamber is maintained substantially within the range of 80–100 percent relative humidity.

36. The photographic film processing system of claim 19, wherein the development station operates to heat the photographic film to a temperature substantially within the range of 40–80 degrees Centigrade.

37. The photographic film processing system of claim 19, wherein the development station includes a halt station operable to substantially stop the continued development of the photographic film.

38. The photographic film processing system of claim 19, wherein the development station includes a film dryer operable to dry the developer solution onto the photographic film.

39. The photographic film processing system of claim 19, wherein the photographic film processing system is embodied as a self-service kiosk.

40. The photographic film processing system of claim 19, wherein the development station further comprises a heating system operable to maintain the temperature of the coated film.

41. The photographic film processing system of claim 19, wherein the development station consistently maintains the temperature of the film within 5 degrees Centigrade of a temperature profile.

42. The photographic film processing system of claim 41, wherein the development station consistently maintains the temperature of the film within 1 degree Centigrade of a temperature profile.

43. A method of processing a photographic film comprising:

coating a development solution onto the photographic film; and transporting the coated photographic film through a development station, wherein the development station operates to develop the coated photographic film in an air environment where the temperature and humidity are substantially controlled.

44. The method of claim 43, wherein development station heats the coated photographic film to a temperature substantially within a range of 40–80 degrees Centigrade.

45. The method of claim 44, wherein the development station heats the coated photographic film to a temperature substantially within a range of 45–60 degrees Centigrade.

46. The method of claim 43, wherein the humidity is substantially maintained within the range of 80–100 percent humidity.

47. The method of claim 43, wherein the development station includes a development tunnel having a housing that forms a development chamber through which the coated photographic film is transported.

48. The method of claim 47, wherein the development tunnel includes a heating system operable to heat the coated photographic film.

49. The method of claim 47, wherein the development tunnel is insulated.

50. The method of claim 43, further comprising scanning the developed film to produce digital images.

51. The method of claim 50, wherein scanning the developed film comprises scanning the developed film through the coating of developer solution.

52. The method of claim 50, further comprising displaying the digital images to a user.

53. The method of claim 50, further comprising printing one or more digital images.

54. The method of claim 43, wherein the developer solution is coated onto the photographic solution using a slot coater device.

55. The method of claim 43, wherein the developer solution is coated onto the photographic solution using a replaceable developer cartridge.

56. The method of claim 43, wherein the processing of the photographic film takes place in self-service kiosk.

* * * * *